US007108454B2

(12) United States Patent
Blackwood

(10) Patent No.: US 7,108,454 B2
(45) Date of Patent: Sep. 19, 2006

(54) SUBSURFACE DRAINAGE SYSTEM AND DRAIN STRUCTURE THEREFOR

(75) Inventor: Charles R. Blackwood, Oklahoma City, OK (US)

(73) Assignee: Airfield Systems, L.L.C., Edmond, OK (US)

( * ) Notice: Subject to any disclaimer, the term of this patent is extended or adjusted under 35 U.S.C. 154(b) by 0 days.

(21) Appl. No.: 10/963,181

(22) Filed: Oct. 12, 2004

(65) Prior Publication Data

US 2006/0078386 A1 Apr. 13, 2006

(51) Int. Cl.
*E02B 11/00* (2006.01)
*E01C 3/00* (2006.01)

(52) U.S. Cl. ..... 405/36; 52/180; 52/169.1

(58) Field of Classification Search ..... 405/32, 405/35, 36; 52/180, 169.1
See application file for complete search history.

(56) References Cited

U.S. PATENT DOCUMENTS

| | | | | |
|---|---|---|---|---|
| 3,461,675 | A | 8/1969 | Izatt | 405/38 |
| 3,908,385 | A | 9/1975 | Daniel et al. | 405/37 |
| 4,268,993 | A | 5/1981 | Cunningham | 47/48.5 |
| 4,860,506 | A * | 8/1989 | Yoshimi et al. | 52/144 |
| 4,956,951 | A * | 9/1990 | Kannankeril | 52/169.5 |
| 5,123,778 | A | 6/1992 | Bohnhoff | 404/28 |
| 5,250,340 | A * | 10/1993 | Bohnhoff | 428/99 |
| 5,752,784 | A | 5/1998 | Motz et al. | 405/37 |
| 5,848,856 | A | 12/1998 | Bohnhoff | 405/36 |
| 5,944,444 | A | 8/1999 | Motz et al. | 405/37 |
| 6,398,455 | B1 | 6/2002 | Volstad | 405/43 |
| 6,428,870 | B1 | 8/2002 | Bohnhoff | 428/44 |
| 6,691,472 | B1 * | 2/2004 | Hubert | 52/169.5 |
| 2003/0082359 | A1 * | 5/2003 | Scott | 428/221 |
| 2005/0058510 | A1 * | 3/2005 | Parker | 405/36 |

* cited by examiner

*Primary Examiner*—Thomas B. Will
*Assistant Examiner*—Tara L. Mayo
(74) *Attorney, Agent, or Firm*—Dunlap Codding & Rogers, P.C.

(57) ABSTRACT

A subsurface drainage assembly for directing fluid drainage from a surface including a plurality of drain structure panels linked together in a manner that permits movement of one drain structure panel relative to the adjacent drain structure panel. The drain structure panels have a laterally extensive backing grid and a plurality of spaced apart support members projecting therefrom. The support members have at least one fluid flow opening formed through a sidewall so as to intersect a lower end of the support members at two rounded corners. The support members are spaced so that the support members are nestable between the support members of an identical drain structure panel when the drain structure panels are arranged in an inverted relationship with respect to one another. The drain structure panel may be placed on an impermeable liner having an upper surface with a plurality of ridges defining troughs therebetween.

11 Claims, 6 Drawing Sheets

SUBSURFACE DRAINAGE SYSTEM AND DRAIN STRUCTURE THEREFOR

BACKGROUND OF THE INVENTION

1. Field of the Invention

The present invention generally relates to systems for subsurface fluid drainage and storage, and more particularly, but not by way of limitation, to a subsurface drainage system and a drain structure therefor which promotes rapid infiltration of water through a subsoil structure.

2. Brief Description of Related Art

It is known that adequate drainage is a key to maintaining quality turf on athletic playing fields, such as football and soccer fields, baseball diamonds, golf courses, and the like. Further, well drained playing fields eliminate or significantly decrease the time during which heavy precipitation would make the field unuseable.

Previous efforts have been made in the field of subsurface drainage systems for sports fields and the like. In particular, U.S. Pat. No. 5,848,856 has been issued to William Bohnhoff. The Bohnhoff '856 patent discloses a subsurface drainage system that includes a base layer having a sloped surface and covered with an impermeable liner, a drainage collection pipe at the bottom of each sloped surface, an intermediate layer formed by a drain structure overlying the impermeable liner, a filter fabric layer, a root zone layer, and a turf. The drain structure is a thermoplastic mat with a laterally extensive backing grid having a plurality of intersecting struts defining grid openings therebetween and a plurality of spaced cylindrical support members projecting from the backing grid whereby fluid may flow through the backing grid and the cylindrical support member.

While use of the drainage structure described above has met with success, the transportation of such drain structures can be expensive, and its installation tedious and time consuming. In addition, the cylindrical support members are typically formed to have a planar lower edge that upon resting on the impermeable liner forms a fluid seal. It has been suggested to form openings in the sidewall that would promote drainage from the cylindrical support member, but the formation of such openings result in the creation of sharp edges that may cut or puncture the impermeable liner during the installation process or after the drain structure is covered with the turf and the soil that makes up the root zone layer. The present invention is directed to a subsurface drainage system and drain structure therefor that overcome the problems of the prior art.

BRIEF DESCRIPTION OF THE SEVERAL VIEW OF THE DRAWINGS

DETAILED DESCRIPTION OF THE INVENTION

Figure 1:
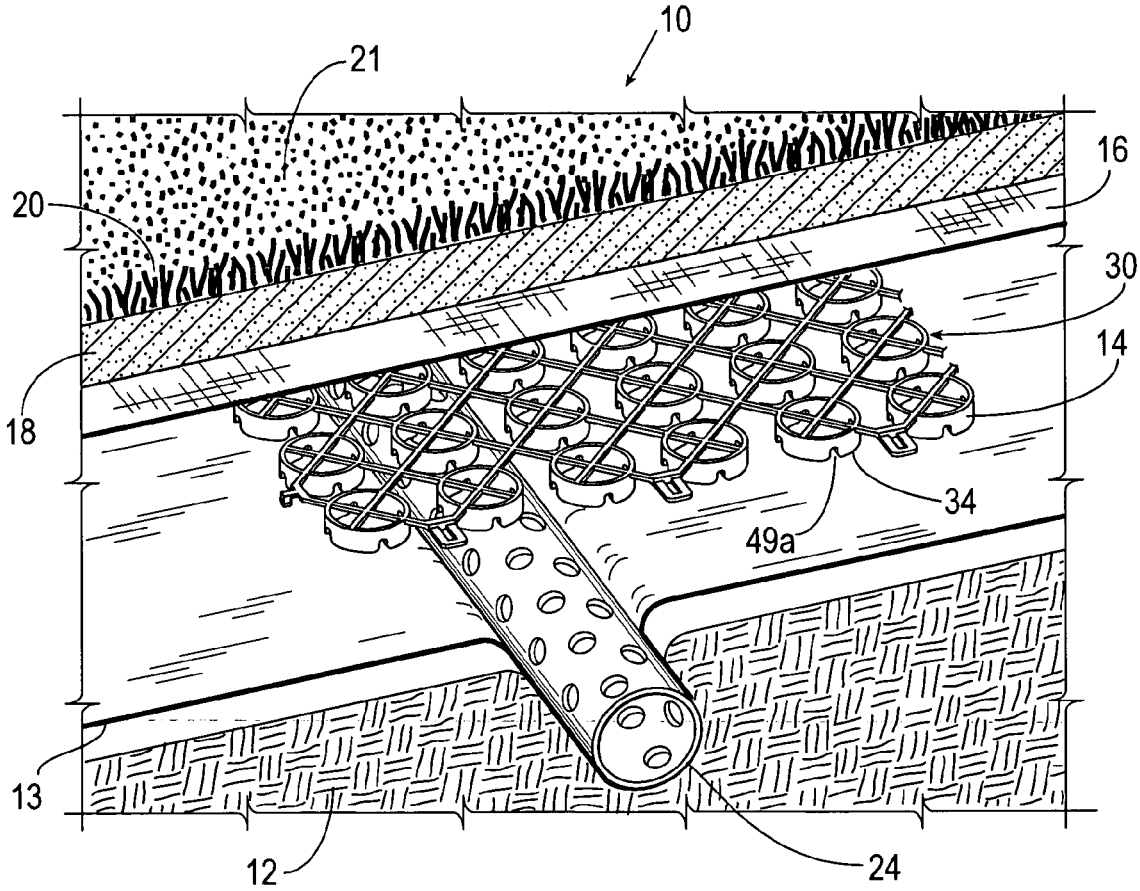
FIG. 1 is a sectional view of a subsurface drainage system constructed in accordance with the present invention.

Referring now to the drawings, and more particularly to FIG. 1, shown is a subsurface drainage system 10 constructed in accordance with the present invention. The subsurface drainage system 10 includes a base layer 12, an impermeable liner 13, a drain structure 14, a semi-permeable filter fabric layer 16, a root zone layer 18, and a turf layer 20 defining a playing surface 21. In instances where it is desirable to allow some permanent deep infiltration of surface drainage, the impermeable liner 22 may be replaced with a semi-permeable geotextile fabric.

The subbase 12 typically includes a subsoil that has been graded and packed to predetermined slope (e.g., five percent) to direct by gravity the movement of subsurface water. The subbase 12 is sloped preferably from about one degree to about fifteen degrees to induce downhill water flow. A perforated collector pipe 24 preferably is installed at the down slope terminus of each sloped portion of the subbase 12. The subbase 12 may be graded to define a broad V-shaped basin with the collector pipe 24 at the bottom thereof so that water drains down opposing sides of the basin toward a common collection point at the bottom of the basin. The invention is not limited to such a configuration, however, and any of a wide variety of sloped subbase arrangements may be used. The area of the subbase 12 will generally correspond to the area of the playing surface 21.

Liquid infiltrating the turf layer 20 percolates downward by the force of gravity through the root zone layer 18 and the filter fabric layer 16 and then encounters the drain structure 14. The liquid flows freely downhill through and along the drain structure 14 until reaching a collection point at the bottom of the sloped surfaces of the subbase 12, where it enters the perforated collector pipe 24 beneath the drain structure 14 and below the grade of the subbase 12. The collector pipe 24 is pitched to provide drainage there along so that the collected liquid may be discharged or collected in a container (not shown) for treatment, off-site disposal, or re-use.

As will be described in greater detail below, the drain structure 14 will generally have an areal size that corresponds to the areal size of the playing surface 21 and provides a permanent layer of subsurface air space or void through which large volumes of fluid may rapidly move. The impermeable liner 13 is positioned between the drain structure 14 and the subbase 12. The filter fabric layer 16 is disposed flush upon the top surface of the drain structure 14 and acts to prevent migration of medium that makes up the root zone layer 18 into the drain structure 14. The root zone layer 18 is deposited to a suitable depth. The entire surface at the top of the root zone layer 18 may then be graded as desired to provide the desired playing surface 21 and the turf layer 20 laid on the root zone layer 18.

It will be appreciated that while the turf layer 20 in FIG. 1 represents natural turf, it will be appreciated that the turf layer 20 may also be artificial turf. In which case, the root zone layer 18 would typically be eliminated and the artificial turf layer placed directly on the filter fabric layer 16.

Depending upon the size and shape of the surface to be drained, and upon the graded configuration and number of sloped surfaces of the subbase 12, a plurality of collector pipes 24 may be networked according to known hydraulic principles to channel and direct into a trunk collector pipe the liquids gathered and drained from the drain structure 14.

Figure 2:
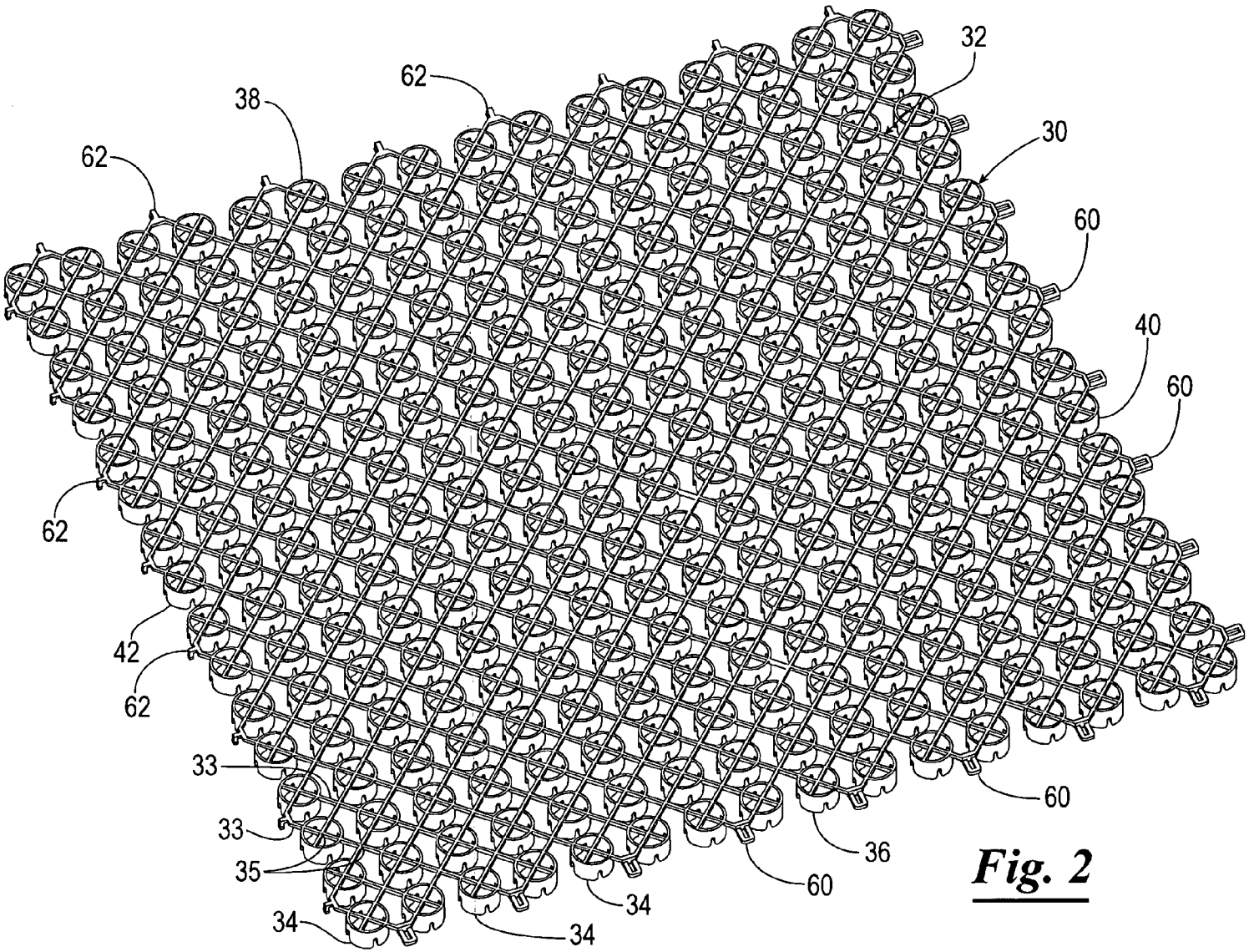
FIG. 2 is a perspective view of a drain structure constructed in accordance with the present invention.

Referring now to FIG. 2, a perspective view of a drain structure panel 30 is illustrated. The drain structure panel 30 is utilized in the construction of the drain structure 14 of FIG. 1. The drain structure 14 is assembled from a plurality of interlinked drain structure panels 30. While FIG. 1 shows a portion of a single drain structure panel 30, it is understood that in the ordinary practice of the invention a plurality of drain structure panels 30 are interconnected in two lateral dimensions, the plurality of panels 30 thus comprising the drain structure 14.

Each drain structure panel 30 preferably is composed of injection-molded plastic, such as high-density polyethylene or polypropylene. Drain structure panels 30 manufactured from low-density polyethylene are also applicable in situations where reduced cost or increased flexibility are desired. Certain elements of each drain structure panel 30 are designed and manufactured to have an inflexible rigidity that provides structural strength to the drain structure 14, yet other portions of each drain structure panel 30 are shaped to be flexible to permit easy rolling, transportation, manipulation, and placement of the drain structure panels 30 for installation and/or assembly. More specifically, each drain structure panel 30 includes a backing grid 32 made from a plurality of intersecting struts 33 and a plurality of spaced support members 34 projecting from the backing grid 32. Certain support members are labeled 34 in FIG. 2, but it is readily understood that a given panel includes a number of other identical support members. The backing grid 32 provides flexibility to the overall drain structure panel 30, while the support members 34 provide desired compression strength.

The support members 34 lend integrity and strength to the drain structure panel 30. The backing grid 32 is moderately flexible in a direction perpendicular to the plane of the drain structure panel 30, interconnects the support members 34, and maintains the support members 34 in a spaced-apart relation to each other. As shown in FIG. 2, the support members 34 preferably are uniformly arrayed horizontally in perpendicular rows and columns. In the illustrated embodiment, the support members 34 are fashioned in the form of cylindrical rings, but it will be appreciated that support members of other than cylindrical shape may be used in the invention. Support members 34 having hexagonal, square, rectangular, or other cross-sectional shapes may be utilized. However, the support members 34 preferably are generally tubular so that water, air, and other fluids may flow freely through the support members 34. Also, the support members 34 need not be arrayed in perpendicular rows and columns, because circular, random, or other arrays may function within the scope of the invention. The support members 34 are preferably of a uniform height, and thus serve to define the overall thickness of the drain structure panel 30, which may be, by way of example, approximately 1.0 inch.

The support members 34 are preferably molded integrally with the backing grid 32. Shown in FIG. 2, each support member 34 is centrally disposed with respect to an intersection 35 of two struts 33, so that each support member 34 has a central longitudinal axis extending through an intersection of struts. Each pair of intersecting struts 33 are securely joined at their respective intersection 35 so that the overall plurality of intersecting struts defines a strong, yet flexible network resistant to stretching or tearing. As with the support members 34, the particular pattern created by the array of struts is not critical, and it is contemplated that the struts 33 may be arranged to intersect other than perpendicularly or arranged such that the struts 33 do not intersect one another. To promote a strong backing grid 32, however, it is preferred that each support member 34 be centrally located about the intersection 35 of two struts 33, and be integrally attached to the corresponding struts.

Notably, the drain structure panel 30 is generally flat with a constant thickness, and defines two substantially parallel planes, one plane containing the backing grid 32 and the other plane generally defined by the opposing ends of the support members 34. The drain structure panel 30 is further characterized as having a first side 36, a second side 38, a third side 40, and a fourth side 42. Advantageously, fluids may freely flow through the grid openings between struts 33. Also, the integration of the support members 34 with the backing grid 32 maintains adjacent support members 34 in a spaced-apart relation, leaving ample space through which fluids may flow.

Figure 3:
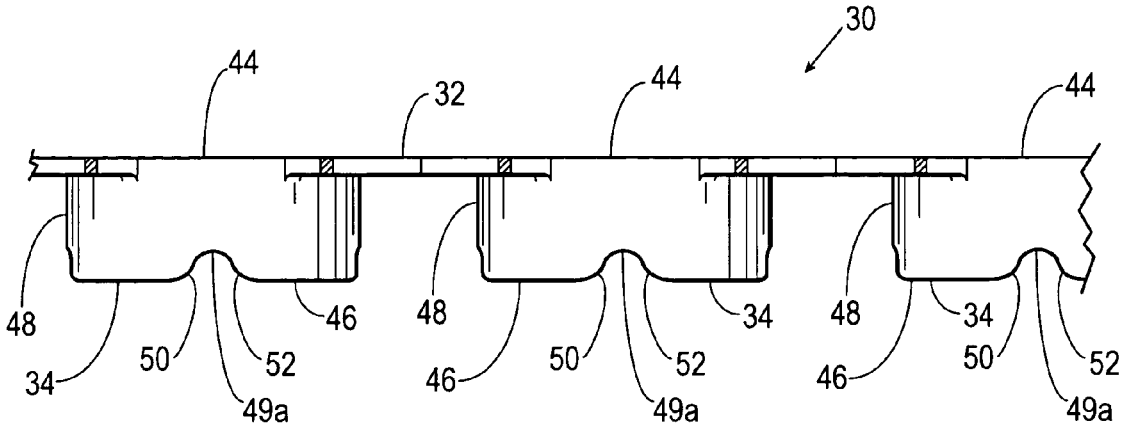
FIG. 3 is a side elevational view of a tubular member of the drain structure of FIG. 2.
Figure 4:
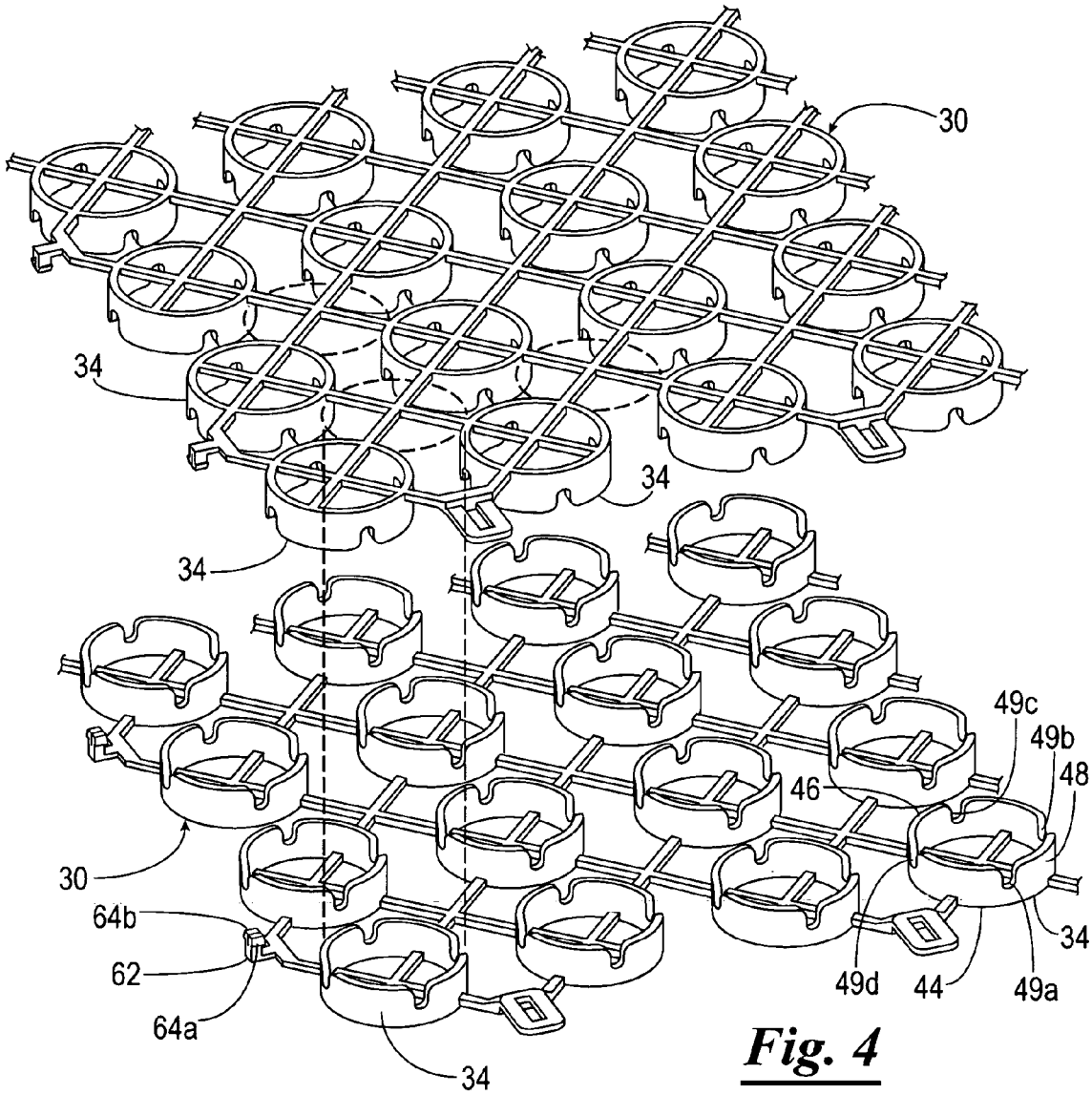
FIG. 4 is a perspective view of a pair of drain structures shown readied to be nested relative to one another.

Referring now to FIGS. 3 and 4, the support members 34 are characterized as having a first end or upper end 44 connected to the backing grid 32, a second end or lower end 46 opposite the first end 44, and a sidewall 48 extending therebetween. To facilitate fluid flow through the support members 34 when the second end 46 of the support members 34 are engaged with the impermeable line 13, each of the support members 34 is provided with a plurality of openings 49*a*–49*d* (best shown in FIGS. 3 and 4) formed through the sidewall 48 on the second end 46 of the support members 34. While four openings are shown disposed at ninety degree intervals in alignment with the first, second, third, and fourth sides 36, 38, 40, 42 of the drain structure panel 30 and formed in the second end 46, it will be appreciated that the position of the openings and the number of openings may be varied. For example, the openings may be angled relative to the first, second, third, and fourth sides 36, 38, 40, 42 of the drain structure panel 30 and the openings may be formed in the first end 44 if the drain structure panel 30 is intended to be placed on the impermeable liner 13 with the backing grid 32 facing down. Also, the support members 34 may be formed with only one opening. In such case, the drain structure 14 would preferably be positioned on the subbase 12 with the opening positioned on the downhill side of the subbase 12 to promote the drainage of fluid therethrough.

The openings 49*a*–49*d* are preferably rounded or arch shaped to eliminate stress risers and sized to permit fluid to flow freely therefrom when the second ends 46 of the support members 34 are engaged with the impermeable liner 13. Additionally, the openings 49*a*–49*d* have two corners 50 and 52 extending from the second end 46 of the support member 34. The corners 50 and 52 are rounded to a sufficient radius to provide a smooth, non-jagged transition from the second end 46 to the openings 49*a*–49*d* which will prevent the impermeable liner 13 from being cut, torn, or punctured while the drain structure 14 is positioned on the impermeable liner 13 during the installation process, and in turn loaded with the weight of the root zone layer 18 and the turf layer 20, as illustrated in FIG. 1. In addition, the rounded corners 50 and 52 facilitate movement of the drain structure 30 over the impermeable liner 13 and relative to another drain structure panel 30 in a manner to be discussed below.

Figure 5:
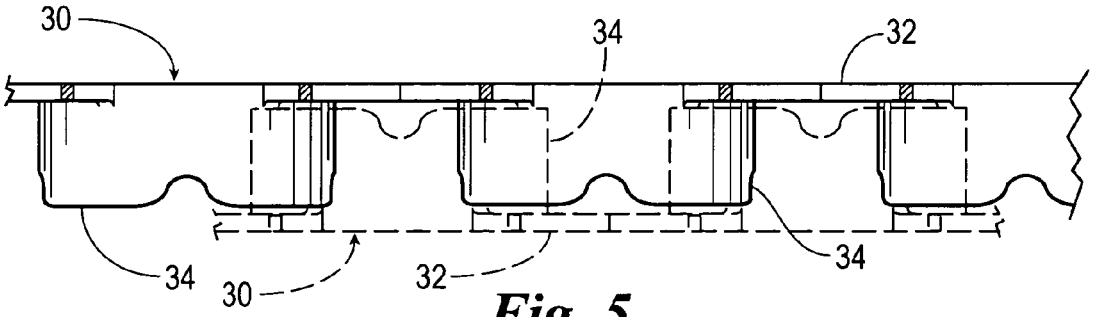
FIG. 5 is a side elevational view of a pair of drain structure shown nested relative to one another.

As described above, the backing grid 32 is moderately flexible in a direction perpendicular to the plane of the drain structure panel 30. Such flexibility permits a row of interconnected drain structure panels 30 to be rolled on a spindle (not shown) for storage and transport. While storing and transporting the drain structure panels 30 in a rolled form permits quick and easy installation, shipping costs are increased due to the amount of space occupied by a row of rolled drain structure panels 30. To reduce space requirements, the support members 34 preferably are spaced apart from one another to permit the support members 34 of one drain structure panel 30 to be nested between the support members 34 of another drain structure panel 30 when the drain structure panels 30 are oriented in an inverted, offset relationship with respect to each other, as shown in FIGS. 4 and 5. Pairs of nested drain structure panels 30 would then be stacked on top of each other.

In use, a plurality of drain structure panels 30 are secured together to form the drain structure 14 of a desired size. To permit attachment between adjacent drain structure panels 30, complementary sets of male and female fasteners are formed on the side edges of each drain structure panel 30. In the illustrated embodiment, the female fasteners are fashioned in the form of sockets 60 formed along the first and fourth sides 36 and 42, respectively, and the male fasteners are fashioned in the form of pins 62 formed along the other second and third sides 38 and 42, respectively, so that the pins 62 are disposed opposite the sockets 60. Any two drain structure panels 30 may be secured in adjacent relation by inserting the pins 62 spaced along one side of one drain structure panel 30 through the sockets 60 spaced along the side of another substantially identical drain structure panel 30. The ends of the pins 62 may be formed with flexible flanged tabs 64*a* and 64*b* (best shown in FIG. 4) to secure the pins 62 in the sockets 60.

During the process of installing the drain structure 14, the drain structure panels 30 are often exposed to radiant heat from the sun. The heat may in turn cause the drain structure panels 30 to expand. Such expansion will cause the drain structure 14 to buckle if adjacent drain structure panels 30 are not able to move relative to one another. In addition, when used with artificial turf, the artificial turf is generally placed on the drain structure 14 with only a filter fabric separating the artificial turf from the drain structure 14. It is well know that artificial turf tends to absorb heat energy which in turn is transferred to the drain structure 14. The heating of the drain structure 14 can again lead to buckling of the drain structure 14. However, in the case of artificial turf can also lead to buckling of the playing surface.

Figure 6:
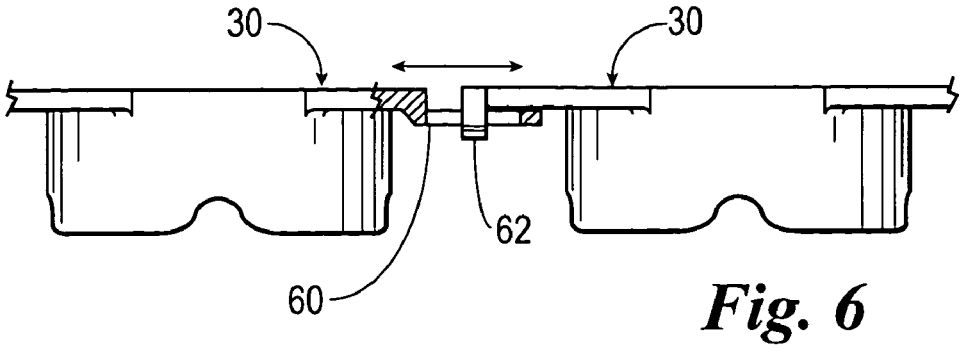
FIG. 6 is a side elevational view a portion of a pair of drain structures shown connected to one another.
Figure 7:
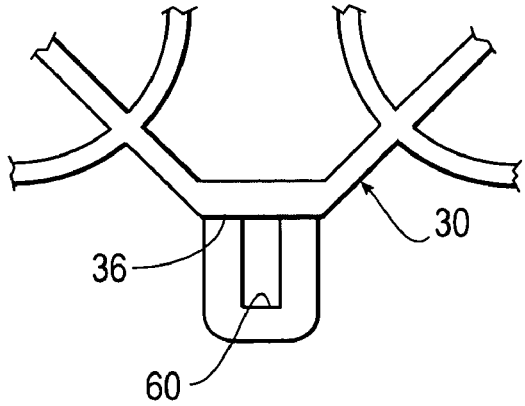
FIG. 7 is a top plan view of a portion of the drain structure illustrating a female connector.

To permit movement of one drain structure panel 30 relative to an adjacent drain structure panel 30, the sockets 60 are shaped to permit compressional and extensional movement of one drain structure panel 30 relative to the adjacent drain structure panels 30 when the drain structure panels 30 are secured to one another. FIG. 7 shows the socket 60 having a rectangular configuration which allows the pins 62 to slide along the length of the sockets 60, as shown in FIG. 6, even after the pins 62 have been snapped or locked into the sockets 60. By way of example, the pin 62 pay have a thickness of approximately 0.25 inches while the socket 60 may have a length of approximately 0.5 to 1.0 inches. While the sockets 60 have been illustrated has having a rectangular configuration, it will be appreciated that the sockets may be formed to have other configurations which would result in a secure attachment while permitting relative movement.

Figure 8:
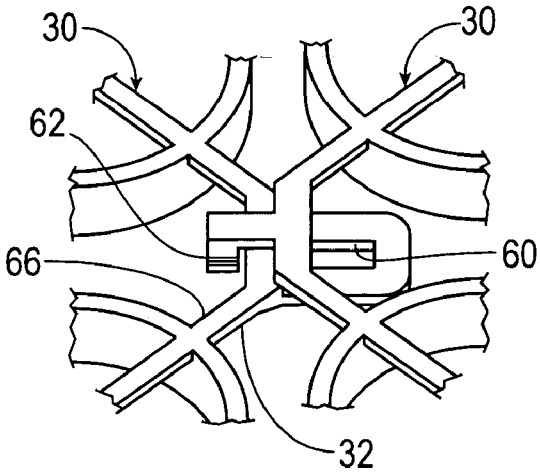
FIG. 8 is a perspective view of a portion of the drain structures of FIG. 4 shown connected to one another in an alternative manner.
Figure 9:
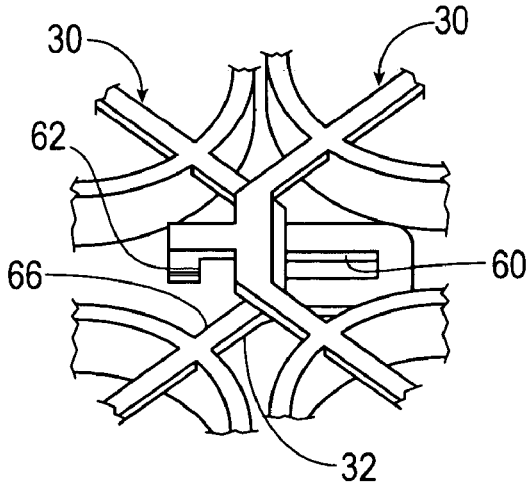
FIG. 9 is a perspective view of the drain structures of FIG. 8 shown in an expanded condition.

FIGS. 8 and 9 illustrate an alternative manner of connecting one drain structure panel 30 to an adjacent drain structure panel 30 that permits the drain structure panels 30 to move relative to one another. Rather than the pins 62 being positioned in the sockets 60, the pins 62 are positioned behind the sockets 60 in a grid opening 66 of the backing grid 32. While this type of connection does not result in a positive attachment of one drain structure panel 30 to another drain structure panel 30 because the pin 62 is not snapped into the space, the connection has the advantage of allowing compressional and extensional movement of one drain structure panel 30 relative to the adjacent drain structure panels 30, as well as lateral movement, while also linking adjacent drain structure panels 30. In addition, the connection illustrated in FIGS. 8 and 9 permits the drain structures panels 30 to be assembled more quickly and easily due to one drain structure panel 30 merely having to be laid on the adjacent drain structure panel 30 without requiring the pins 62 to be aligned with and snapped into the sockets 60.

The high volume capacity and fluid transmissivity of the drain structure 14 provides a reliable means for circulating heated or other treated fluids throughout the subsurface. Heated air, for example, can be pumped into one edge of the drain structure 14 and withdrawn from another edge, allowing the heat to rise to, for example, an overlying football field in cold climates. Coupled with the use of an insulated field blanket, this feature of the drain structure 14 can extend the turf growing season for the field, and improve field conditions during snow storms. Alternatively or additionally, small diameter pipe networks may be installed in the drain structure 14 between the support structures 34 of the drain structure panels 30 to provide subsurface heating or cooling.

The installation of the drainage system 10 is briefly described again with reference to FIG. 1. The subbase 12 is graded according to methods and designs known in the art to define one or more surfaces sloping down to points or lines of fluid collection, that is, points toward which fluids flow upon the subbase's sloping surfaces. The subbase 12 preferably is packed to about 95% modified proctor density. The impermeable liner 13, or, alternatively, a non-woven needle-punched semipermeable geotextile layer, is placed directly upon the subbase 12 to conform to its profile. The perforated collector pipe 24 is installed in a trench cut into the subbase 12, generally along each collection point at the bottom of each sloping surface of the subbase 12. Multiple collector pipes 24 are interconnected, as needed, to define a collector pipe network through which water will flow by gravity. The trench containing the collector pipe 24 is then backfilled with small gravel to the grade of the subbase 12.

After the installation of the collector pipe 24, optional, but desirable, systems are placed. Examples include an irrigation distribution system and risers, and/or heat distribution manifolds for connection to the drain structure 14 or to a pipe network to be placed within the drain structure 14. Also, foundations for such surface structures such as goal posts, bleachers, stages, and the like are placed.

Generally, the backing grid 32 of the drain structure panels 30 is placed face up, towards the ground surface and away from the subbase 12, to provide a smooth profile upon which to lay the semi-permeable filter fabric layer 16, and the openings 49*a*–49*d* of the support members 34 are placed adjacent the impermeable liner 13 to foster fluid escape from the support members 34. The flexibility of the backing grid 32 permits the drain structure 14 to bend and flex to adapt to the overall contour and profile of the underlying subbase 12, yet the rigidity of the support members 34 maintains the uniform thickness of the drain structure 14.

The semi-permeable filter fabric layer 16, such as a non-woven heat calendared geotextile, is next placed upon the drain structure 14 using shingle-overlapped joints. The widest roll of fabric preferably is used to minimize joints, and all joints may be secured with a suitable tape or similar fastener to prevent small particle intrusion through the semi-permeable filter fabric layer and into the drain structure 14.

The root zone layer 18 is then placed upon the filter fabric layer 16. It will be appreciated that the root zone layer 18 may vary in depth and composition. However, by way of example, the root zone soil layer 18 may be placed to a depth of from about eight inches to about eighteen inches. Furthermore, the root zone layer 18 will typically include a mixture of sand, organic matter, and inorganic matter in a ratio that will allow a water infiltration rate of about four inches to six inches per hour. The root zone layer 18 is topped with the turf layer 20 or other landscaping media.

Figure 10:
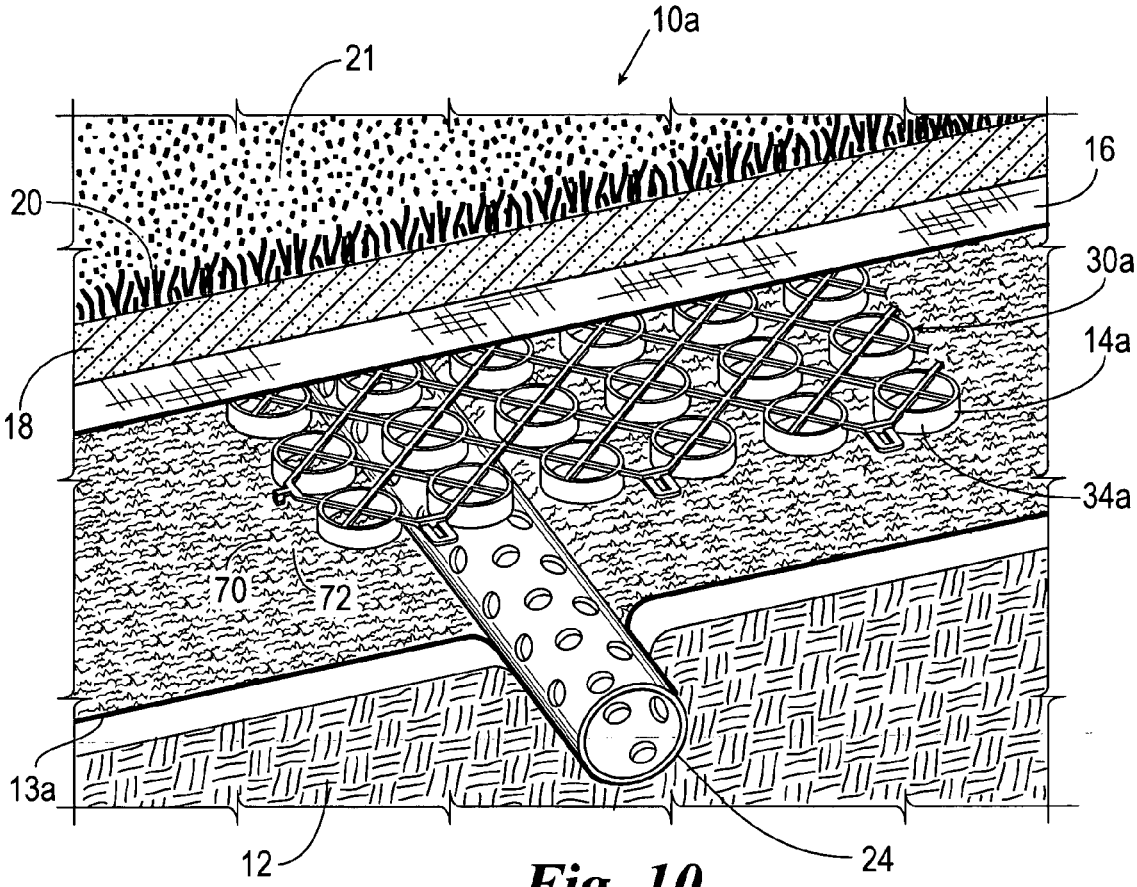
FIG. 10 is a sectional view of another embodiment of a subsurface drainage system constructed in accordance with the present invention.

Referring now to FIG. 10, another embodiment of a subsurface drainage system 10*a* constructed in accordance with the present invention is illustrated. The subsurface drainage system 10*a* is similar to the subsurface drainage system 10 described above except as described below. More specifically, the subsurface drainage system 10*a* includes a base layer 12, an impermeable liner 13*a*, a drain structure 14*a*, a semi-permeable filter fabric layer 16, a root zone layer 18, and a turf layer 20 defining a playing surface 21. Again, the root zone layer 18 may be eliminated if the turf layer 20 is artificial turf.

The drain structure 14*a* is identical to the drain structure 14 described above except the drain structure 14*a* is assembled from a plurality of drain structure panels 30*a* which include support members 34*a*. The support members 34*a* differ from the support members 34 described above in that the support members 34*a* are not formed with no openings in the sidewall to promote the drainage of fluid from the support members 34*a*. Instead, the impermeable liner 13*a* is formed to have a textured surface which produces a plurality of ridges 70 and troughs 72. The lower end of the support members 34*a* rest on the top of the ridges 70 thereby allowing fluid to flow from the support members 34*a* via the troughs 72. While the support members 34*a* have been shown as not having openings in the sidewalls, it will be appreciated that the drain structure panels 30 described above with the openings 49*a*–49*d* may be used in combination with the impermeable liner 13*a* to further facilitate the drain of fluid from the support members 34.

From the above description, it is clear that the present invention is well adapted to carry out the objects and to attain the advantages mentioned herein, as well as those inherent in the invention. While a presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A drain structure panel for a subsurface drainage assembly, comprising:

a laterally extensive backing grid having a plurality of struts defining grid openings therebetween and a plurality of side edges;

a plurality of spaced apart support members projecting from the backing grid, the support members having an upper end, a lower end, and a sidewall extending therebetween, each of the support members having at least one opening formed through the sidewall so as to intersect the lower end of the support members whereby fluid may flow from the support members via the opening when the lower end of the support member is engaged with a surface, the opening includes two corners extending from the lower end of the support member, wherein each of the corners is rounded; and complementary sets of male and female fasteners formed on the side edges for connecting the drain structure panel to a laterally adjacent drain structure panel, the male fasteners being received in and slidingly locked to the female fasteners of the adjacent drain structure panel, wherein the male and female fasteners substantially permit expansion and contraction of the drain structure panel and the adjacent drain structure panel relative to one another in a lateral direction.

2. The drain structure panel of claim 1 wherein the female fasteners are the grid openings defined by the struts of the backing grid.

3. A subsurface drainage assembly for directing fluid drainage from a surface, comprising:

a sub-base beneath the surface;

an impermeable liner overlying the sub-base;

a plurality of drain structure panels linked together and overlying the impermeable liner, each drain structure panel comprising:

a laterally extensive backing grid having a plurality of struts defining grid openings therebetween; and a plurality of side edges;

a plurality of spaced apart support members projecting from the backing grid, the plurality of support members each having an upper end, a lower end, and a sidewall extending therebetween, each of the support members having at least one opening formed through the sidewall so as to intersect the lower end of the support members whereby fluid may flow from the support members via the openings with the lower end of the support member engaged with the impermeable liner, the openings including two corners extending from the lower end of the support member, wherein each of the corners is rounded to prevent damage to the impermeable liner; and complementary sets of male and female fasteners formed on the side edges for connecting the drain structure panel to a laterally adjacent drain structure panel, the male fasteners being received in and slidingly locked to the female fasteners of the adjacent drain structure panel, wherein the male and female fasteners substantially permit expansion and contraction of the drain structure panel and the adjacent drain structure panel relative to one another in a lateral direction.

4. The subsurface drainage assembly of claim 3 wherein the support members are spaced from one another so that the support members are positionable between the support members of another drain structure panel when the drain structure panels are arranged in an inverted, offset relationship with respect to one another.

5. The subsurface drainage assembly of claim 3 wherein the female fasteners are the grid openings defined by the struts of the backing grid.

6. The subsurface drainage assembly of claim 3 wherein the impermeable liner has an upper surface with a plurality of ridges defining troughs therebetween whereby the lower end of the support members are supported by the ridges of the impermeable liner and fluid may flow from the support members through the troughs of the impermeable liner.

7. A subsurface drainage assembly for directing fluid drainage from a surface, comprising:

a sub-base beneath the surface;

an impermeable liner overlying the sub-base, the impermeable liner having an upper surface with a plurality of ridges defining troughs therebetween; and a plurality of drain structure panels linked together and engaging the impermeable liner, each drain structure panel comprising:

a laterally extensive backing grid having a plurality of struts defining grid openings therebetween and a plurality of side edges;

a plurality of spaced apart support members projecting from the backing grid, the plurality of support members each having an upper end, a lower end, and a sidewall extending therebetween, at least a portion of the support members engaging the upper surface of the impermeable liner so that the lower end of the support members rest on top of the ridges of the impermeable liner whereby fluid may flow from the support members through the troughs of the impermeable liner; and complementary sets of male and female fasteners formed on the side edges for connecting the drain structure panel to a laterally adjacent drain structure panel, the male fasteners being received in and slidingly locked to the female fasteners of the adjacent drain structure panel, wherein the male and female fasteners substantially permit expansion and contraction of the drain structure panel and the adjacent drain structure panel relative to one another in a lateral direction.

8. The subsurface drainage system of claim 7 wherein the support members have a plurality of opening formed through the sidewall so as to intersect the lower end of the support members, the openings include two corners extending from the lower end of the support member, and each of the corners is rounded to prevent the impermeable liner from being damaged.

9. The subsurface drainage assembly of claim 7 wherein the female fasteners are the grid openings defined by the struts of the backing grid.

10. A drain structure for a subsurface drainage assembly, comprising:

a first drain structure panel, the first drain structure panel comprising:

a laterally extensive backing grid having a plurality of struts defining grid openings therebetween and a plurality of side edges; and a plurality of spaced apart support members projecting from the backing grid, the support members having an upper end connected to the backing grid, a lower end, and a sidewall extending therebetween; and a second drain structure panel, the second drain structure panel comprising:

a laterally extensive backing grid having a plurality of struts defining grid openings therebetween and a plurality of side edges;

a plurality of spaced apart support members projecting from the backing grid, the support members having an upper end connected to the backing grid, a lower end, and a sidewall extending therebetween; and complementary sets of male and female fasteners formed on the side edges of both the first and second drain structure panels for connecting the first drain structure panel to the second drain structure panel, the male fasteners of one of the drain structure panels being received in and slidingly locked to the female fasteners of the other of the drain structure panels, wherein the male and female fasteners substantially permit expansion and contraction of the first and second drain structure panels relative to one another in a lateral direction.

11. The drain structure of claim 10 wherein the female fasteners are the grid openings defined by the struts of the backing grid.

* * * * *

UNITED STATES PATENT AND TRADEMARK OFFICE

CERTIFICATE OF CORRECTION

PATENT NO. : 7,108,454 B2
APPLICATION NO. : 10/963181
DATED : September 19, 2006
INVENTOR(S) : Charles R. Blackwood It is certified that error appears in the above-identified patent and that said Letters Patent is hereby corrected as shown below:

Column 8, Line 28: After the word "therebetween" delete the "semi-colon".

Signed and Sealed this

Twentieth Day of March, 2007

JON W. DUDAS
*Director of the United States Patent and Trademark Office*